US009640882B2

(12) United States Patent
Wang et al.

(10) Patent No.: US 9,640,882 B2
(45) Date of Patent: May 2, 2017

(54) CONNECTOR AND IT DEVICE

(71) Applicant: Huawei Technologies Co., Ltd., Shenzhen (CN)

(72) Inventors: Dong Wang, Shenzhen (CN); Qingshe Wu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/143,189

(22) Filed: Apr. 29, 2016

(65) Prior Publication Data

US 2016/0248181 A1 Aug. 25, 2016

Related U.S. Application Data

(63) Continuation of application No. PCT/CN2014/084398, filed on Aug. 14, 2014.

(30) Foreign Application Priority Data

Nov. 5, 2013 (CN) ..... 2013 2 0693947 U

(51) Int. Cl.
*H01R 13/631* (2006.01)
*H01R 12/70* (2011.01)
(Continued)

(52) U.S. Cl.
CPC ..... *H01R 12/7005* (2013.01); *H01R 12/71* (2013.01); *H01R 13/052* (2013.01); *H01R 13/187* (2013.01)

(58) Field of Classification Search
CPC ..... H01R 13/631
(Continued)

(56) References Cited

U.S. PATENT DOCUMENTS 5,391,091 A * 2/1995 Nations ..... H01R 12/7047 439/359
5,690,504 A * 11/1997 Scanlan ..... H01R 12/7005 439/378
(Continued)

FOREIGN PATENT DOCUMENTS

CN 102983439 A 3/2013
CN 203553422 A 4/2014
(Continued)

OTHER PUBLICATIONS

Partial English Translation and Abstract of Chinese Patent Application No. CN102983439, May 17, 2016, 3 pages.
(Continued)

*Primary Examiner* — Gary Paumen
(74) *Attorney, Agent, or Firm* — Conley Rose, P.C.

(57) ABSTRACT

A connector including a female pin and a male pin is disclosed, wherein the female pin includes a first elastic sheet seat and an elastic sheet, the first elastic sheet seat is provided with a first seat hole, a pin bar extending-out hole, and a guide transition hole communicated with the first seat hole and the pin bar extending-out hole. The elastic sheet is assembled inside the first seat hole. The male pin includes a base and a pin bar fastened to the base. The pin bar includes a large-diameter part and a small-diameter part, wherein the large-diameter part is used to fit a clamping portion of the elastic sheet, and wherein the small-diameter part is used to fit the pin bar extending-out hole. A guide transition hole and a pin bar extending-out hole of a first elastic sheet seat achieve a guiding function for insertion of a pin bar.

10 Claims, 7 Drawing Sheets

(51) Int. Cl.

| | |
|---|---|
| ***H01R 13/187*** | (2006.01) |
| ***H01R 12/71*** | (2011.01) |
| ***H01R 13/05*** | (2006.01) |

(58) Field of Classification Search
USPC ..... 439/378
See application file for complete search history.

(56) References Cited

U.S. PATENT DOCUMENTS

| | | | | |
|---|---|---|---|---|
| 6,059,600 | A * | 5/2000 | Vanbesien | H01R 13/41 439/378 |
| 7,621,754 | B2 * | 11/2009 | Costello | H01R 13/7031 439/378 |
| 8,360,796 | B2 * | 1/2013 | Daubigney | H01R 13/6275 439/345 |
| 9,312,616 | B2 * | 4/2016 | Ludwig | H01R 12/7005 |
| 2003/0207607 | A1 | 11/2003 | Matsumoto et al. | |
| 2005/0282427 | A1 * | 12/2005 | Carullo | H01R 13/629 439/378 |
| 2010/0015834 | A1 | 1/2010 | Siebens | |
| 2010/0077593 | A1 * | 4/2010 | Ceelen | F16L 1/10 29/464 |
| 2011/0256753 | A1 * | 10/2011 | Gulla | H01R 12/91 439/378 |
| 2013/0090001 | A1 * | 4/2013 | Kagotani | H01R 13/60 439/378 |

FOREIGN PATENT DOCUMENTS

| | | | |
|---|---|---|---|
| DE | 4325289 | A1 | 4/1995 |
| DE | 102004033567 | A1 | 1/2006 |
| DE | 102005041922 | A | 3/2007 |
| DE | 202008005394 | U1 | 9/2008 |
| JP | 2003323932 | A | 11/2003 |

OTHER PUBLICATIONS

Partial English Translation and Abstract of Chinese Patent Application No. CN203553422, May 17, 2016, 3 pages.
Partial English Translation and Abstract of German Patent Application No. DE102005041922, May 17, 2016, 8 pages.
Partial English Translation and Abstract of German Patent Application No. DE4325289, Part 1, Oct. 26, 2016, 4 pages.
Partial English Translation and Abstract of German Patent Application No. DE4325289, Part 2, Oct. 26, 2016, 3 pages.
Partial English Translation and Abstract of German Patent Application No. DE202008005394, Part 1, Oct. 26, 2016, 8 pages.
Partial English Translation and Abstract of German Patent Application No. DE202008005394, Part 2, Oct. 26, 2016, 4 pages.
Foreign Communication From a Counterpart Application, European Application No. 14859623.2, Extended European Search Report is dated Oct. 19, 2016, 6 pages.
Foreign Communication From a Counterpart Application, PCT Application No. PCT/CN2014/084398, English Translation of International Search Report dated Nov. 19, 2014, 3 pages.
Foreign Communication From a Counterpart Application, PCT Application No. PCT/CN2014/084398, English Translation of Written Opinion dated Nov. 19, 2014, 6 pages.

* cited by examiner

CONNECTOR AND IT DEVICE

CROSS-REFERENCE TO RELATED APPLICATIONS

This application is a continuation of International Application No. PCT/CN2014/084398, filed on Aug. 14, 2014, which claims priority to Chinese Patent Application No. 201320693947.6, filed on Nov. 5, 2013, both of which are hereby incorporated by reference in their entireties.

TECHNICAL FIELD

This disclosure relates to the field of Information Technology (IT) device technologies, and in particular, to a connector and an IT device.

BACKGROUND

Currently, IT products face challenges of high layout density, a high through-current capability, and increasing total power. Transmission of a large current requires a larger copper thickness, but a high-speed signal backplane does not support an excessive copper thickness. Detachably connecting the high-speed signal backplane to a power supply backplane can effectively solve layout and through-current problems, and has become a major development trend of IT products.

In the prior art, a high-speed signal backplane is detachably connected to a power supply backplane mainly using a plug-in connector. As shown in FIG. 1, a structure of an existing connector includes a male pin 1 and a female pin 2. When the male and female pins fit, the male pin 1 is inserted into the female pin 2, and is in contact with an elastic sheet 21 of the female pin 2 in order to implement a conductive connection.

A defect of the prior art lies in that, a connector cannot implement blind-mating; when a tolerance (which refers to an allowed capability of an offset between a male pin and a female pin when the male pin and the female pin fit) is greater than ±0.1 millimeters (mm) (a state shown in FIG. 1), deformation damage of an elastic sheet of the female pin is easily caused, thereby affecting reliability of an electrical connection.

SUMMARY

This disclosure provides a connector and an IT device in order to improve reliability of board-level interconnection of the IT device. A first aspect of this disclosure provides a connector, including a female pin and a male pin, wherein the female pin includes a first elastic sheet seat and an elastic sheet, wherein the first elastic sheet seat is provided with a first seat hole, a pin bar extending-out hole, and a guide transition hole communicated with the first seat hole and the pin bar extending-out hole, and the elastic sheet is assembled inside the first seat hole, and the male pin includes a base and a pin bar fastened to the base, wherein the pin bar includes a large-diameter part and a small-diameter part, the large-diameter part is used to fit a clamping portion of the elastic sheet, and the small-diameter part is used to fit the pin bar extending-out hole.

In a possible implementation manner of the first aspect, a length of the small-diameter part is greater than a sum of lengths of the elastic sheet and the pin bar extending-out hole.

In a possible implementation manner of the first aspect, the pin bar extending-out hole is in clearance fit with the small-diameter part.

In a possible implementation manner of the first aspect, the pin bar is provided with a cone-shaped pinhead, and there is a transition chamfer between the large-diameter part and the small-diameter part.

In a possible implementation manner of the first aspect, the female pin further includes a second elastic sheet seat, wherein the second elastic sheet seat is provided with a second seat hole and a pin bar through-hole; the elastic sheet includes a part extending out of the first seat hole, where the part, extending out of the first seat hole, of the elastic sheet is assembled inside the second seat hole; and the pin bar is penetrated into the pin bar through-hole.

In a possible implementation manner of the first aspect, the pin bar through-hole is in clearance fit with the large-diameter part.

In the technical solutions of this disclosure, a guide transition hole and a pin bar extending-out hole of a first elastic sheet seat achieve a guiding function for insertion of a pin bar. Even though a tolerance between a male pin and a female pin is relatively large, an insertion direction of the pin bar of the male pin can be correctly guided, thereby reducing damage to an elastic sheet and greatly improving reliability of an electrical connection. Therefore, blind-mating can be implemented. In addition, a guide pin or a guide pin hole does not need to be designed on a board, which reduces a layout area of the board and effectively improves layout density of the board.

A second aspect of this disclosure provides an IT device, including a first printed circuit board and a second printed circuit board that require board-level interconnection, and the connector according to the technical solution of any one of the foregoing embodiments, where a base of a male pin of the connector is fastened to the first printed circuit board, and a first elastic sheet seat of a female pin of the connector is fastened to the second printed circuit board. The IT device has relatively high reliability of board-level interconnection and can implement blind-mating; and layout density of a board is relatively high.

DESCRIPTION OF EMBODIMENTS

In order to improve reliability of board-level interconnection of an IT device, embodiments of this disclosure provide a connector and an IT device. In the technical solutions, a guide transition hole and a pin bar extending-out hole of a first elastic sheet seat achieve a guiding function for insertion of a pin bar. Even though a tolerance between a male pin and a female pin is relatively large, an insertion direction of the pin bar of the male pin can be correctly guided, thereby reducing damage to an elastic sheet and greatly improving reliability of an electrical connection. Therefore, blind-mating can be implemented. To make the objectives, technical solutions, and advantages of this disclosure clearer, the following further describes this disclosure in detail with reference to specific embodiments.

Figure 1:
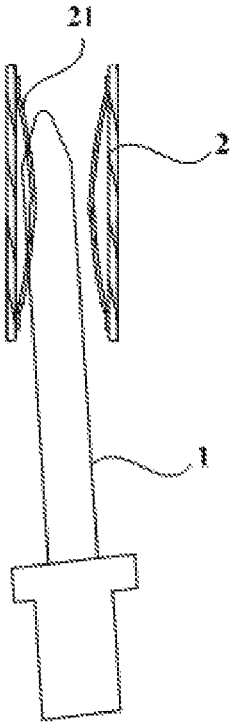
FIG. 1 is a schematic diagram of a connection state of an existing connector.
Figure 2A:
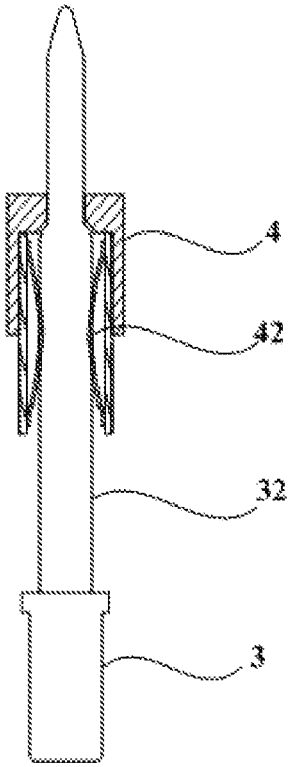
FIG. 2A is a schematic diagram of a connection state of an embodiment of a connector according to this disclosure.
Figure 2B:
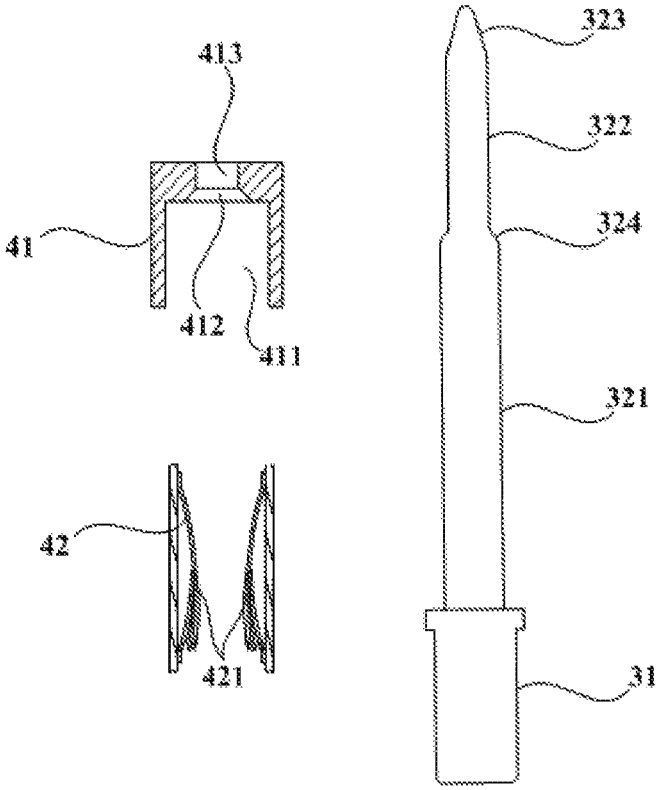
FIG. 2B is a schematic diagram of a split structure of the connector shown in FIG. 2A.

As shown in FIG. 2A and FIG. 2B, a connector in an embodiment of this disclosure includes a female pin 4 and a male pin 3.

The female pin 4 includes a first elastic sheet seat 41 and an elastic sheet 42. The first elastic sheet seat 41 is provided with a first seat hole 411, a pin bar extending-out hole 413, and a guide transition hole 412 communicated with the first seat hole 411 and the pin bar extending-out hole 413. The elastic sheet 42 is assembled inside the first seat hole 411.

The male pin 3 includes a base 31 and a pin bar 32 fastened to the base 31. The pin bar 32 includes a large-diameter part 321 and a small-diameter part 322. The large-diameter part 321 is used to fit a clamping portion 421 of the elastic sheet 42, and the small-diameter part 322 is used to fit the pin bar extending-out hole 413.

Figure 2C:
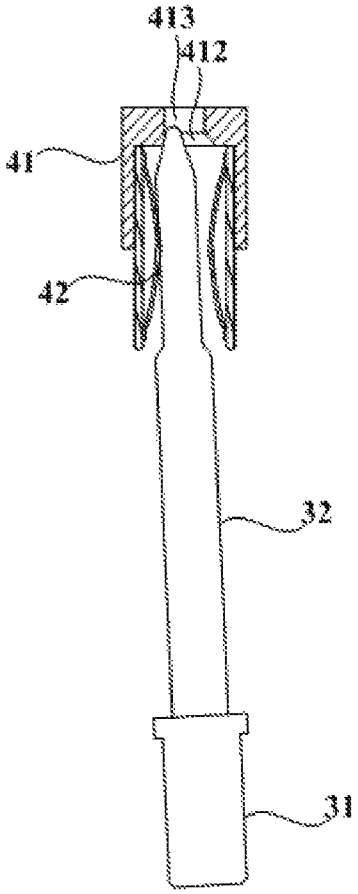
FIG. 2C is a schematic diagram showing that a male pin of the connector shown in FIG. 2A is inserted into a female pin thereof.

The connector provided by this embodiment of this disclosure may be applied to various devices on which board-level interconnection needs to be performed. For example, the connector may be used for board-level interconnection between a high-speed signal backplane and a power supply backplane of an IT device. The first elastic sheet seat 41 of the female pin 4 and the base 31 of the male pin 3 are separately fastened to a Printed Circuit Board (PCB). When the male pin 3 is plugged into the female pin 4, the pin bar 32 of the male pin 3 penetrates through the clamping portion 421 of the elastic sheet 42. In this case, if there is a relatively large tolerance (for example, greater than ±0.1 mm) between the male pin 3 and the female pin 4, as shown in FIG. 2C, the male pin 3 continues to be inserted, a pinhead that is in contact with a hole wall of the guide transition hole 412 moves to the pin bar extending-out hole 413 under a guiding function of the hole wall of the guide transition hole 412, and further continues to penetrate out of the pin bar extending-out hole 413. In this case, the tolerance between the male pin 3 and the female pin 4 is eliminated, thereby eventually enabling the pin bar 32 to be in good contact with the clamping portion 421 of the elastic sheet 42, as shown in FIG. 2A.

Still referring to FIG. 2A to FIG. 2C, when the male pin 3 is plugged into the female pin 4, the small-diameter part 322 of the male pin 3 achieves a guiding function. The small-diameter part 322 first penetrates through the clamping portion 421 of the elastic sheet 42, the male pin 3 continues to be inserted, and a head (that is, a pinhead of the male pin 3) of the small-diameter part 322 that is in contact with the hole wall of the guide transition hole 412 moves to the pin bar extending-out hole 413 under the guiding function of the hole wall of the guide transition hole 412, and further penetrates out of the pin bar extending-out hole 413 under a guiding function of a hole wall of the pin bar extending-out hole 413. The large-diameter part 321 is limited at the guide transition hole 412. In this case, the male pin 3 cannot be inserted any more, and the male pin 3 is plugged into the female pin 4 in place.

The pin bar 32 is designed to have two degrees of thickness, where the small-diameter part 322 can avoid contact with or be in minimum contact with the clamping portion 421 when penetrating through the clamping portion 421 of the elastic sheet 42 in order to reduce damage (that is, deformation damage of the elastic sheet 42 in a non-elastic compression direction) of the elastic sheet 42, and the large-diameter part 321 can be clamped after entering the clamping portion 421, thereby implementing good conductive contact.

Under the premise of ensuring intensity, a diameter of the small-diameter part 322 of the pin bar 32 should be as small as possible. In this way, the small-diameter part 322 is easier to penetrate through the clamping portion 421 of the elastic sheet 42 in order to reduce damage to the elastic sheet 42. For length design, a length of the small-diameter part 322 is preferably greater than a sum of lengths of the elastic sheet 42 and the pin bar extending-out hole 413. The small-diameter part 322 achieves a relatively good guiding function. In addition, the small-diameter part 322 is still located inside the clamping portion 421 of the elastic sheet 42 and is not in contact with or in little contact with the clamping portion 421 before an insertion direction of the pin bar 32 is correctly guided, which, therefore, also helps to reduce damage to the elastic sheet 42.

The pin bar extending-out hole 413 is in clearance fit with the small-diameter part 322. The pin bar extending-out hole 413 achieves a more accurate guiding function for the small-diameter part 322 to penetrate out. After the small-diameter part 322 extends out of the pin bar extending-out hole 413, the male pin 3 is plugged into the female pin 4 in place.

As shown in FIG. 2B, in this embodiment, the pin bar is provided with a cone-shaped pinhead 323, and there is a transition chamfer 324 between the large-diameter part 321 and the small-diameter part 322. The cone-shaped pinhead 323 guides the pin bar to penetrate through the clamping portion 421 of the elastic sheet 42 and the pin bar extending-out hole 413 of the first elastic sheet seat 41, which can further reduce damage to the elastic sheet 42, and help to prolong a service life of the connector. The transition chamfer 324 is designed between the large-diameter part 321 and the small-diameter part 322, which not only is convenient for processing and helps to improve overall intensity of the pin bar 32, but also can further reduce damage to the elastic sheet 42 caused by penetration of the pin bar.

In the technical solutions of this disclosure, a guide transition hole 412 and a pin bar extending-out hole 413 of a first elastic sheet seat 41 achieve a guiding function for insertion of a pin bar 32. Even though a tolerance between a male pin 3 and a female pin 4 is relatively large, an insertion direction of the pin bar 32 of the male pin can be correctly guided (which finally presents a state shown in FIG. 2A), thereby reducing damage to an elastic sheet 42 and greatly improving reliability of an electrical connection. Therefore, blind-mating can be implemented. In addition, a guide pin or a guide pin hole does not need to be designed on a board, which reduces a layout area of the board and effectively improves layout density of the board.

Figure 3A:
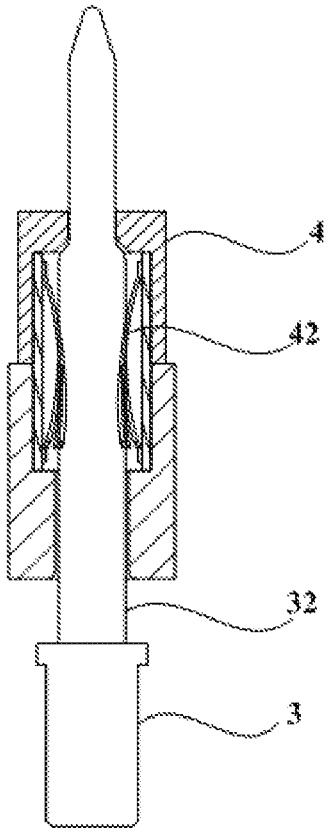
FIG. 3A is a schematic diagram of a connection state of another embodiment of a connector according to this disclosure.
Figure 3B:
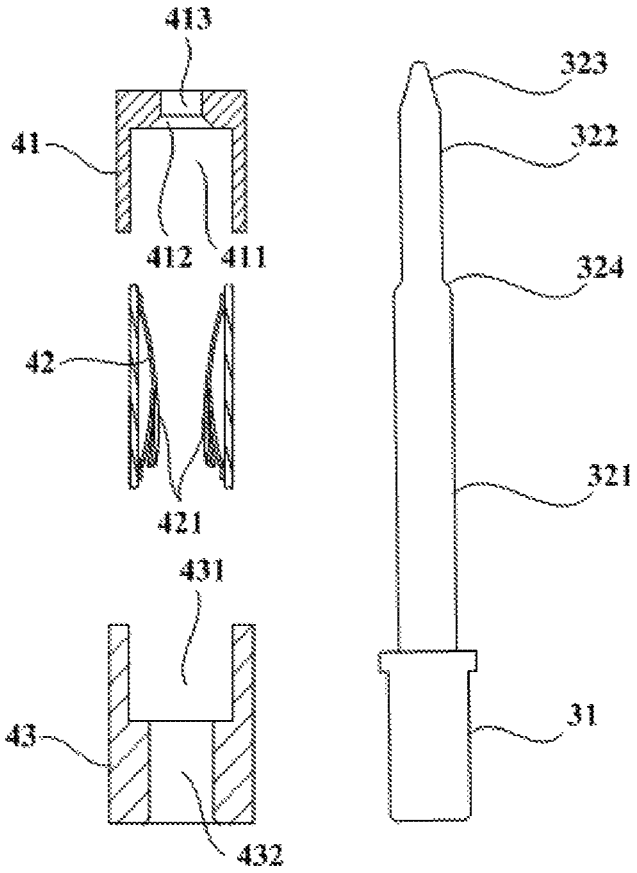
FIG. 3B is a schematic diagram of a split structure of the connector shown in FIG. 3A.

As shown in FIG. 3A and FIG. 3B, in another exemplary embodiment of this disclosure, the female pin 4 further includes a second elastic sheet seat 43, where the second elastic sheet seat 43 is provided with a second seat hole 431 and a pin bar through-hole 432. The elastic sheet 42 includes a part extending out of the first seat hole 411, where the part, extending out of the first seat hole 411, of the elastic sheet 42 is assembled inside the second seat hole 431, and the pin bar 32 is penetrated into the pin bar through-hole 432.

Figure 3C:
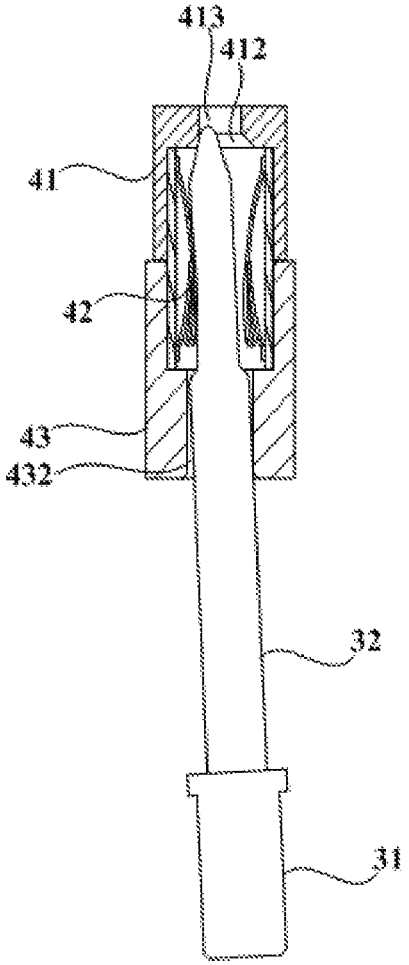
FIG. 3C is a schematic diagram showing that a male pin of the connector shown in FIG. 3A is inserted into a female pin thereof.

When the male pin 3 starts to be inserted into the female pin 4, the pin bar through-hole 432 of the second elastic sheet seat 43 achieves a guiding function for the pin bar 32 of the male pin 3 in order to reduce an insertion deviation between the male pin 3 and the female pin 4. The pin bar through-hole 432 is preferably in clearance fit with the large-diameter part 321, and can achieve a relatively accurate guiding function. As shown in FIG. 3C, even though the tolerance between the male pin 3 and the female pin 4 is relatively large, the insertion direction of the pin bar 32 of the male pin can be correctly guided (which finally presents a state shown in FIG. 3A), thereby reducing damage to the elastic sheet 42. Therefore, blind-mating can be implemented.

An embodiment of this disclosure further provides an IT device, including a first printed circuit board and a second printed circuit board that require board-level interconnection, and the connector according to the technical solution of any one of the foregoing embodiments, where a base of a male pin of the connector is fastened to the first printed circuit board, and a first elastic sheet seat of a female pin of the connector is fastened to the second printed circuit board. The IT device has relatively high reliability of board-level interconnection and can implement blind-mating; and layout density of a board is relatively high.

Obviously, a person skilled in the art can make various modifications and variations to this disclosure without departing from the spirit and scope of this disclosure. In this way, this disclosure is intended to cover these modifications and variations provided that these modifications and variations to this disclosure fall within the scope of the claims of this disclosure and their equivalent technologies.

What is claimed is:

1. A connector, comprising:

a female pin comprising a first elastic sheet seat and an elastic sheet; and a male pin comprising a base and a pin bar fastened to the base, wherein the first elastic sheet seat is provided with a first seat hole, a pin bar extending-out hole, and a guide transition hole communicated with the first seat hole and the pin bar extending-out hole, wherein the elastic sheet is assembled inside the first seat hole, wherein the pin bar comprises a large-diameter part and a small-diameter part, wherein the large-diameter part is used to fit a clamping portion of the elastic sheet, wherein the small-diameter part is used to fit the pin bar extending-out hole, wherein the female pin further comprises a second elastic sheet seat, wherein the second elastic sheet seat is provided with a second seat hole and a pin bar through-hole, wherein the elastic sheet comprises a part extending out of the first seat hole, wherein the part extending out of the first seat hole of the elastic sheet is assembled inside the second seat hole, and wherein the pin bar is penetrated into the pin bar through-hole.

2. The connector according to claim 1, wherein a length of the small-diameter part is greater than a sum of lengths of the elastic sheet and the pin bar extending-out hole.

3. The connector according to claim 1, wherein the pin bar extending-out hole is in clearance fit with the small-diameter part.

4. The connector according to claim 1, wherein the pin bar is provided with a cone-shaped pinhead, and wherein there is a transition chamfer between the large-diameter part and the small-diameter part.

5. The connector according to claim 1, wherein the pin bar through-hole is in clearance fit with the large-diameter part.

6. A communication device, comprising:

a first printed circuit board; and a second printed circuit hoard, wherein the first printed circuit board and the second printed circuit board require board-level interconnection; and a connector comprising a female pin and a male pin, wherein the female pin comprises a first elastic sheet seat and an elastic sheet, wherein the first elastic sheet seat is provided with a first seat hole, a pin bar extending-out hole, and a guide transition hole communicated with the first seat hole and the pin bar extending-out hole wherein the elastic sheet is assembled inside the first seat hole, wherein the male pin comprises a base and a pin bar fastened to the base, wherein the pin bar comprises a large-diameter part and a small-diameter part, wherein the large-diameter part is used to fit a clamping portion of the elastic sheet, wherein the small-diameter part is used to fit the pin bar extending-out hole, wherein a base of a male pin of the connector is fastened to the first printed circuit board, wherein a first elastic sheet seat of a female pin of the connector is fastened to the second printed circuit board, wherein the female pin further comprises a second elastic sheet seat, wherein the second elastic sheet seat is provided with a second seat hole and a pin bar through-hole, wherein the elastic sheet comprises a part extending out of the first seat hole, wherein the part extending out of the first seat hole of the elastic sheet is assembled inside the second seat hole, and wherein the pin bar is penetrated into the pin bar through-hole.

7. The device according to claim 6, wherein a length of the small-diameter part is greater than a sum of lengths of the elastic sheet and the pin bar extending-out hole.

8. The device according to claim 6, wherein the pin bar extending-out hole is in clearance fit with the small-diameter part.

9. The device according to claim 6, wherein the pin bar is provided with a cone-shaped pinhead, and wherein a transition chamfer is disposed between the large-diameter part and the small-diameter part.

10. The connector according to claim 6, wherein the pin bar through-hole is in clearance fit with the large-diameter part.

* * * * *